US005290427A

United States Patent [19]

Fletcher et al.

[11] Patent Number: 5,290,427

[45] Date of Patent: Mar. 1, 1994

[54] GASOLINE UPGRADING PROCESS

[75] Inventors: David L. Fletcher, Turnersville; Timothy L. Hilbert, Sewell; Michael S. Sarli, Haddonfield; Stuart S. Shih, Cherry Hill, all of N.J.

[73] Assignee: Mobil Oil Corporation, Fairfax, Va.

[21] Appl. No.: 925,007

[22] Filed: Aug. 5, 1992

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[5] ..... C10G 45/00

[52] U.S. Cl. ..... 208/89; 208/213; 208/212

[58] Field of Search ..... 208/89, 213

[56] References Cited

U.S. PATENT DOCUMENTS

| | | | |
|---|---|---|---|
| 3,759,821 | 9/1973 | Brennan et al. | 208/93 |
| 3,767,568 | 10/1973 | Chen | 208/134 |
| 3,923,641 | 12/1975 | Morrison | 208/111 |
| 3,957,625 | 5/1976 | Orkin | 208/211 |
| 4,006,076 | 2/1977 | Christensen et al. | 208/213 |
| 4,049,542 | 9/1977 | Gibson et al. | 208/213 |
| 4,062,762 | 10/1977 | Howard et al. | 208/211 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/216 R |
| 5,143,596 | 9/1992 | Maxwell et al. | 208/89 |

*Primary Examiner*—Helane Myers

*Attorney, Agent, or Firm*—A. J. McKillop; M. D. Keen

[57] ABSTRACT

Low sulfur gasoline is produced from a catalytically cracked, sulfur-containing naphtha by fractionating the naphtha feed into a number of fractions of differing boiling range and hydrodesulfurizing them by by feeding them into a hydrodesulfurization reactor at spaced locations along the length of the reactor in order of descending boiling range, with the highest boiling fraction first. Staged introduction of the feed into the hydrodesulfurization reactor in this way promotes desulfurization of the sulfur-rich, olefin poor back end of the feed while reducing the saturation of the high octane olefins in the olefin-rich, sulfur-poor front end, so preserving octane while achieving the desired desulfurization. The hydrodesulfurization is followed by treatment over an acidic catalyst, preferably an intermediate pore size zeolite such as ZSM-5. The treatment over the acidic catalyst in the second step restores octane loss which takes place as a result of the hydrogenative treatment and results in a low sulfur gasoline product with an octane number comparable to that of the feed naphtha.

30 Claims, 3 Drawing Sheets

GASOLINE UPGRADING PROCESS

CROSS REFERENCE TO RELATED APPLICATIONS

This pending application is a continuation-in-part of our prior application Ser. No. 07/850,106, filed 12 Mar. 1992, which, in turn, is a continuation-in-part of our prior application Ser. No. 07/745,311, filed 15 Aug. 1991. It is also a continuation-in-part of Ser. No. 07/745,311.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane. Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In our co-pending applications Ser. Nos. 07/850,106, filed 12 Mar. 1992, and Ser. No. 07/745,311, filed 15 Aug. 1991, we have described a process for the upgrading of gasoline by sequential hydrotreating and selective cracking steps. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/745,311 and 07/850,106 for a detailed description of this process.

While the olefins in the cracked gasolines are mainly in the front end of these fractions, the sulfur-containing impurities tend to be concentrated in the back end, mainly as thiophenes and other heterocyclic compounds, although some front end sulfur may be encountered in the form of mercaptans. The desulfurization takes place readily during the hydrodesulfurization step but is inevitably accompanied by saturation of the olefins; although the resulting loss in product octane is restored in the second step of the process, it would clearly be desirable to reduce the olefin saturation as much as possible so as to retain octane while, at the same time, achieving the desired degree of desulfurization.

SUMMARY OF THE INVENTION

We have now devised a process scheme which enables the desulfurization in the first step of the process to be carried out in a way which reduces the saturation of the olefins while achieving the desired desulfurization. This is done by splitting the cracked gasoline feed into a number of fractions of increasing boiling range and injecting these fractions into the hydrodesulfurization reactor at spaced locations in order of the boiling ranges of the fractions with the heavier or heaviest fraction entering the reactor at its inlet and the lighter or lightest fraction near the outlet.

According to the present invention, a sulfur-containing cracked petroleum fraction in the gasoline boiling range is fractionated to form two or more fractions of increasing boiling range which are hydrotreated, in a first stage, under conditions which remove at least a substantial proportion of the sulfur. The hydrodesulfurization is carried out in a fixed-bed hydrodesulfurization (HDS) reactor having inlet locations for the feed along its axis from the inlet to the outlet. Fractions of the feed are introduced into the reactor through these inlets with the higher or highest boiling fraction entering at the inlet and with the other fraction or fractions entering at spaced locations along the length of the reactor, in the order of descending boiling range. In this way, the lightest or lowest boiling fraction which is subjected to the desulfurization is introduced into the HDS reactor near its outlet.

The hydrodesulfurization produces an intermediate product which is then treated, in a second stage, by contact with a catalyst of acidic functionality under conditions which convert the hydrotreated intermediate product fraction to a fraction in the gasoline boiling range of higher octane value. The preferred catalysts used in this step are usually zeolite catalysts syuch as ZSM-5, zeolite beta or MCM-22.

DETAILED DESCRIPTION

Feed

Figure 1:
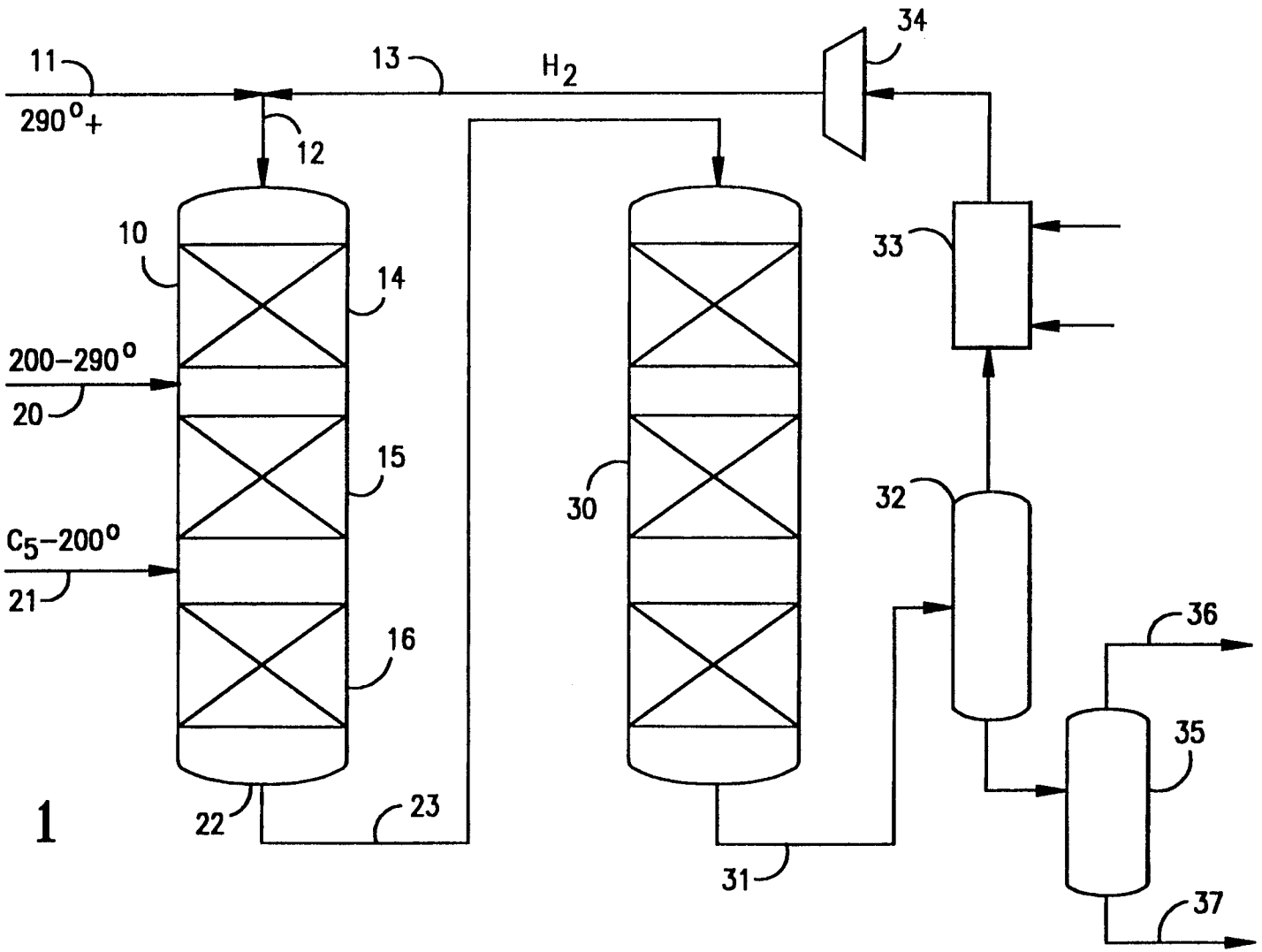
FIG. 1 is a simplified process schematic for the present process.

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F.(163° C.) and preferably at least about 350° F.(177° C.), for example, 95 percent points of at least 380° F. (about 193° C.) or at least about 400° F. (about 220° C.).

The process may be operated with the entire gasoline fraction obtained from the catalytic cracking step or, alternatively, with part of it, depending on the amount and the identity of the sulfur compounds present. If the front end of the cracked fraction contains relatively few sulfur components, it may be possible separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F.(93° C.) to about 300° F.(150° C.) will be suitable. The exact cut point selected will depend on the sulfur specification for the gasoline product as well as on the type of sulfur compounds present: lower cut points will typically be necessary for lower product sulfur specifications.

The sulfur which is present in components boiling below about 150° F.(65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F.(82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F.(193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15-20, weight percent.

Process Configuration

The selected sulfur-containing, gasoline boiling range feed is first split into two or more fractions before being passed to the HDS unit. The fractions are then treated in two steps by first hydrotreating them to remove sulfur while minimizing the saturation of olefins, after which the octane loss resulting from olefin saturation during the hydrotreating is restored at least partially by treatment with the acidic catalyst in the next step of the process.

The olefins in the feed are concentrated in the front end together with the mercaptan sulfur while the back end is relatively poorer in olefins but richer in thiophenes and other cyclic sulfur compounds which require more severe desulfurization conditions than the mercaptans. The compositions of three typical catalytically cracked naphthas are given below in Tables 1 to 3 to illustrate the variation in feed properties across the boiling range.

TABLE 1

FCC GASOLINE NO. 1

| | Full Range | IBP-133 | 133.167 | 167-185 | 185-200 | 200-233 | 233-267 |
|---|---|---|---|---|---|---|---|
| Pct. of Total Gaso., wt | 100 | 23.2 | 8.1 | 5.3 | 4.5 | 9.7 | 9.0 |
| , Vol | 100 | — | — | — | — | 9.7 | 9.4 |
| API Gravity | 56.7 | — | — | — | — | 57.2 | 49.8 |
| Hydrogen, wt % | 12.99 | — | 14.40 | 14.01 | 13.79 | 13.25 | 12.53 |
| Sulfur, wt % | 0.24 | — | 0.03 | 0.07 | 0.09 | 0.13 | 0.19 |
| Mercaptans, ppm | 2 | — | 3 | 1 | <1 | <1 | <1 |
| Nitrogen, ppm | 57 | — | 13 | 14 | 15 | 15 | 23 |
| Basic Nitrogen, ppm | — | — | <5 | <5 | <5 | <5 | 19 |
| Bromine No. | 35.3 | — | 111 | 101.5 | 92.3 | 83.7 | 68.1 |
| Diene No. | — | — | 7.8 | 7.8 | 4.6 | 6.8 | 0.67 |
| PONA, wt % | | | | | | | |
| Paraffins | 16.8 | — | — | — | 27.6 | 26.4 | 14.2 |
| Mono-Naphthenes | 81 | — | — | — | 16.3 | 17.1 | 9.2 |
| Mono-Olefins | 22.2 | — | — | — | 29.1 | 23.9 | 22.2 |
| Di-Naphthenes | 0.6 | — | — | — | 0.0 | 0.0 | 0.4 |
| Cyclo & Di-Olefins | 11.9 | — | — | — | 10.1 | 9.2 | 12.8 |
| Alkyl Benzenes | 35.4 | — | — | — | 16.7 | 23.1 | 41.0 |
| Indenes & Tetralins | 3.9 | — | — | — | 0.1 | 0.2 | 0.2 |
| Naphthalenes | 1.0 | — | — | — | 0.0 | 0.0 | 0.0 |

| | 267-300 | 300-315 | 315-333 | 333-367 | 367+ |
|---|---|---|---|---|---|
| Pct. of Total Gaso., wt | 9.6 | 5.0 | 5.5 | 8.2 | 14.4 |
| , Vol | 8.9 | — | — | 7.3 | 12.4 |
| API Gravity | 44.1 | — | — | 36.5 | 30.8 |
| Hydrogen, wt % | 11.91 | 11.69 | 11.62 | 11.65 | 11.42 |
| Sulfur, wt % | 0.23 | 0.26 | 0.27 | 0.28 | 0.71 |
| Mercaptans, ppm | 3 | 17 | 3 | 6 | 1 |
| Nitrogen, ppm | 45 | 64 | 87 | 150 | 170 |
| Basic Nitrogen, ppm | 28 | 54 | 84 | 132 | 128 |
| Bromine No. | 49.3 | 39.4 | 35.1 | 28.5 | 21.9 |
| Diene No. | 7 | 6 | 4 | 3 | 0.3 |
| PONA, wt % | | | | | |
| Paraffins | 11.8 | 11.3 | 10.5 | 11.3 | — |
| Mono-Naphthenes | 7.2 | 5.8 | 4.6 | 4.2 | — |
| Mono-Olefins | 15.9 | 14.0 | 13.0 | 11.5 | — |
| Di-Naphthenes | 0.4 | 0.6 | 0.8 | 1.1 | — |
| Cyclo & Di-Olefins | 9.4 | 7.0 | 5.7 | 4.8 | — |
| Alkyl Benzenes | 54.8 | 59.9 | 62.4 | 58.7 | — |
| Indenes & Tetralins | 0.5 | 1.5 | 3.0 | 7.8 | — |
| Naphthalenes | 0.0 | 0.0 | 0.0 | 0.6 | — |

TABLE 2

FCC Gasoline No. 2

| | Boiling Range, °F. | | | | | | | | |
|---|---|---|---|---|---|---|---|---|---|
| | Full Range | 80-167 | 167-200 | 200-233 | 233-267 | 267-300 | 300-333 | 333-367 | 367+ |
| Pct. of Total Gaso., wt | 100 | 33 | 10.2 | 10.7 | 8.9 | 8.2 | 8.1 | 5.0 | 15.9 |
| , Vol | 100 | 37.3 | 10.7 | 10.7 | 8.6 | 7.6 | 7.3 | 4.4 | 13.5 |
| API Gravity | 57.6 | 81.8 | 65.7 | 57.4 | 49.7 | 43.7 | 38.7 | 35.2 | 29.3 |
| Hydrogen, wt % | 13.16 | — | 14.11 | 13.45 | 12.66 | 11.94 | 11.58 | 11.42 | 11.07 |

TABLE 2-continued

| | FCC Gasoline No. 2 | | | | | | | | |
|---|---|---|---|---|---|---|---|---|---|
| | Boiling Range, °F. | | | | | | | | |
| | Full Range | 80-167 | 167-200 | 200-233 | 233-267 | 267-300 | 300-333 | 333-367 | 367+ |
| Sulfur, wt % | 0.12 | — | 0.04 | 0.08 | 0.12 | 0.13 | 0.14 | 0.16 | 0.45 |
| Nitrogen, ppm | 56 | — | 7 | 8 | 14 | 30 | 84 | 150 | 210 |
| Basic Nitrogen, ppm | — | — | — | — | — | — | 79 | — | 171 |
| Bromine No. | 70.6 | — | 89.3 | 70.9 | 54.2 | 36.6 | 22.5 | 17.1 | 15.6 |
| Diene content | 0.1 | — | 0.44 | 0.46 | 0.32 | 0.33 | 0.18 | <0.1 | <0.1 |
| Di-olefins, wt % | — | — | 4.0 | 4.5 | 3.4 | 3.7 | 2.2 | 1 | 1 |
| PONA, wt % | | | | | | | | | |
| Paraffins | 22.2 | — | 29.2 | 23.9 | 17.8 | 17.2 | 13.3 | 13.1 | 17.1 |
| Mono-Naphthenes | 10.4 | — | 13.8 | 14.1 | 11.1 | 10.2 | 5.3 | 4.2 | 4.7 |
| Mono-Olefins | 21.7 | — | 37.0 | 29.8 | 21.3 | 12.2 | 10.3 | 8.2 | 6.7 |
| Di-Naphthenes | 0.2 | — | 0.0 | 0.0 | 0.4 | 0.5 | 0.7 | 0.9 | 1.1 |
| Cyclo & Di-Olefins | 7.1 | — | 9.5 | 11.0 | 10.2 | 4.8 | 4.1 | 3.1 | 2.9 |
| Alkyl Benzenes | 34.9 | — | 10.5 | 21.0 | 39.1 | 54.9 | 64.0 | 63.1 | 43.7 |
| Indanes & Tetralins | 2.8 | — | 0.0 | 0.1 | 0.1 | 0.2 | 2.2 | 6.8 | 17.6 |
| Naphthalenes | 0.6 | — | 0.0 | 0.0 | 0.0 | 0.0 | 0.0 | 0.6 | 6.2 |

TABLE 3

| | FCC Gasoline No. 3 | | | | | | |
|---|---|---|---|---|---|---|---|
| | Boiling Range, °F. | | | | | | |
| | Full Range | IBP-200 | 200-250 | 250-275 | 275-297 | 297-319 | 319-338 |
| Pct. of Total Gaso., vol. | 100 | 42.7 | 13.8 | 7.2 | 4.9 | 4.9 | 4.8 |
| , wt. | 100.0 | 38.1 | 13.8 | 7.5 | 5.2 | 5.3 | 5.3 |
| Hydrogen, % wt | 12.57 | 14.55 | 13.15 | 12.36 | 11.99 | 11.67 | 11.54 |
| Sulfur, wt % | 0.36 | 0.049 | 0.193 | 0.239 | 0.248 | 0.244 | 0.222 |
| Nitrogen, ppm | 53 | 17 | 14 | 16 | 32 | 47 | 69 |
| Bromine No. | 53.9 | 94.3 | 55.14 | 37.4 | 28.1 | 22.4 | 17.7 |
| Phenol, wt % | 0.24 | L/T0.0001 | 0.0109 | 0.10 | 0.25 | 0.42 | 0.68 |
| PONA, wt. pct. | | | | | | | |
| Paraffins | 23.2 | 39.1 | 24.5 | 19.1 | 17.7 | 17.1 | 15.6 |
| Monoolefins | 17.8 | 32.2 | 19.5 | 16.8 | 12.8 | 10.0 | 7.7 |
| Cyclo & Diolefins | 6.1 | 7.6 | 9.9 | 7.8 | 5.1 | 3.5 | 2.3 |
| Cn $H_{2n-4}$ | 0.0 | 0.2 | 0.3 | 0.3 | 0.5 | 0.4 | 0.5 |
| Total Olefins | 23.9 | 40.0 | 29.7 | 25.1 | 18.4 | 13.9 | 10.5 |
| Monocycloparaffins | 11.0 | 14.1 | 19.4 | 12.8 | 11.3 | 8.7 | 7.1 |
| Dicycloparaffins | 0.6 | 0.0 | 0.3 | 0.5 | 0.5 | 0.7 | 1.0 |
| Total Naphthenes | 11.6 | 14.1 | 19.7 | 13.3 | 11.8 | 9.4 | 8.1 |
| Alkyl Benzenes | 34.5 | 6.4 | 25.9 | 42.6 | 52.0 | 55.9 | 61.2 |
| Indanes & Tetralins | 4.4 | 0.2 | 0.1 | 0.1 | 0.1 | 3.1 | 3.8 |
| Naphthalenes | 2.3 | 0.2 | 0.0 | 0.0 | 0.0 | 0.6 | 0.8 |
| Total Aromatics | 41.2 | 6.8 | 26.0 | 42.7 | 52.1 | 59.6 | 65.8 |

| | Boiling Range, °F. | | | | |
|---|---|---|---|---|---|
| | 338-360 | 360-383 | 383-416 | 416-448 | 448+ |
| Pct. of Total Gaso., vol. | 4.9 | 4.2 | 5.0 | 5.0 | 2.6 |
| , wt. | 5.3 | 4.7 | 5.8 | 5.9 | 3.1 |
| Hydrogen, % wt | 11.39 | 11.38 | 10.98 | 10.58 | — |
| Sulfur, wt % | 0.210 | 0.243 | 0.741 | 1.32 | 2.75 |
| Nitrogen, ppm | 106 | 128 | 113 | 91 | 289 |
| Bromine No. | 15.3 | 13.3 | 11.3 | 10.0 | 10.5 |
| Phenol, wt % | 0.82 | 0.92 | 0.71 | 0.38 | 0.23 |
| PONA, wt. pct. | | | | | |
| Paraffins | 15.2 | 14.6 | 16.6 | 15.4 | |
| Monoolefins | 7.0 | 6.2 | 6.0 | 6.1 | |
| Cyclo & Diolefins | 1.7 | 0.8 | 1.6 | 2.6 | |
| Cn $H_{2n-4}$ | 1.1 | 2.1 | 1.7 | 1.4 | |
| Total Olefins | 9.8 | 9.1 | 9.3 | 10.1 | |
| Monocycloparaffins | 6.0 | 5.7 | 6.8 | 7.0 | |
| Dicycloparaffins | 1.0 | 1.1 | 1.1 | 1.3 | |
| Total Naphthenes | 7.0 | 6.8 | 7.9 | 8.3 | |
| Alkyl Benzenes | 58.1 | 53.7 | 34.9 | 26.0 | |
| Indanes & Tetralins | 8.3 | 14.5 | 21.6 | 22.2 | |
| Naphthalenes | 1.6 | 1.4 | 9.6 | 17.8 | |
| Total Aromatics | 68.0 | 69.6 | 66.1 | 66.0 | |

The typical gasoline compositions given in Table 1 to 3 above show that there are marked compositional changes across the boiling range of the cracked naptha feeds. The present process exploits these changes in a way which promotes the removal of the sulfur while, at the same time, attempts to minimize the saturation of the olefins which make a significant contribution to the octane of the final gasoline. To this end, the fractions are introduced at spaced locations along the length of the fixed-bed HDS reactor with the sulfur-rich, olefin-poor, higher boiling fractions being fed into the reactor at the inlet end with the other fraction or fractions introduced into the reactor in order of decreasing boiling range. In this way, the sulfur compounds which require the more severe conditions for effective removal are given an extended contact time while the more readily removed mercaptans are inroduced towards the end of the reactor together with the olefin-rich portions of the feed which require, at the most, only a low severity treatment with a short contact time.

The hydrodesulfurization of the fractions is carried out with a hydrotreating catalyst, which is suitably a conventional hydrotreating catalyst, such as a combination of a Group VI and a Group VIII metal on a suitable refractory support such as alumina. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

This hydrotreated intermediate product which also boils in the gasoline boiling range, is then treated by contact with an acidic catalyst under conditions which produce a second product comprising a fraction which boils in the gasoline boiling range which has a higher octane number than the portion of the hydrotreated intermediate product fed to this second step. The product from this second step is of lower sulfur content than the original feed while having a comparable octane rating as the result of the second stage treatment.

The catalyst used in the second stage of the process has a significant degree of acid activity, and for this purpose the most preferred materials are the aluminosilicate zeolites, preferably the intermediate pore size zeolites such as ZSM-5.

The figure illustrates in simplified form a suitable process configuration for carrying out the present gasoline upgrading process. The cracked gasoline feed is split into three fractions which are in order of increasing boiling range: $C_5$-200°, 200°-290° and 290° F.+ ($C_5$-930°, 93°-143°, 143° C. +). (Temperatures in this specification are expressed on the Fahrenheit scale unless the contrary is stated). The highest boiling 290°+F. (93° C.+) fraction from line 11 is introduced into hydrodesulfurization reactor 10 through inlet 12 together with hydrogen recycled through line 13. The HDS reactor has three superimposed catalyst beds, 14, 15 and 16, each comprising a hydrodesulfurization catalyst, as described below. Distribution trays and vapor/liquid mixing devices are suitably in the interbed spaces and above the first bed, as is conventional.

The next lower boiling fraction of the feed boiling from 200° to 290° F. (about 93° to 143° C.), is introduced into the reactor through side inlet 20 so that this portion of the feed enters the reactor after the first catalyst bed 14. The effluent from bed 14 is then mixed with the incoming fraction from inlet 20 and the two then pass through second catalyst bed 15 where further hydrodesulfurization reactions take place.

The lightest portion of the feed, the $C_5$-200° F. ($C_5$-93° C.) fraction, is introduced into the reactor after the second bed through inlet 21. It mixes with the effluent from bed 15 and the combined material then passes through the final catalyst bed 16 before passing out of the reactor through outlet 22 to line 23.

The hydrotreated intermediate product passes along line 23 to the inlet 24 of the second stage reactor 30 in which the hydrotreated intermediate product is passed over the acidic catalyst to restore octane lost in the hydrodesulfurization step. The effluent from reactor 30 passes through line 31 to high temperature separator 32 in which the hydrogen together with ammonia and hydrogen sulfide is removed from the hydrocarbons. The hydrogen is passed to amine scrubber 33 in which the ammonia and hydrogen sulfide are removed and the purified hydrogen is recompressed in compressor 34 before being returned to reactor 10 through line 13. The hydrocarbons are separated in low temperature separator 35 with the light ends passing out through outlet 36 and the upgraded gasoline product through outlet 37.

The injection of the feed fractions along the length of the HDS reactor progressively increases the space velocity of the feed in the catalyst beds, so that the treatment severity in each bed progressively decreases. In addition, the treatment duration of each fraction is shorter, according to the injection point, with the lowest boiling fractions having the shorter or shortest treatment times. Together, these effects are effective to reduce the saturation of the olefins which, as noted above, are found mostly in the lower boiling fractions while maintaining the desulfurization of the higher boiling fractions in which the sulfur compounds tend to be concentrated. Some olefin saturation will take place but will be reduced as a result of the stepwise injection of the feed but is less than would otherwise occur, creating a potential for a reduction in hydrogen consumption. At the same time, injection of the heaviest fraction of the gasoline feed at the beginning of the hydrodesulfurization reactor promotes the desulfurization of this sulfur-rich but olefin-poor fraction.

Other advantages also accrue from the spaced injection of the feed fractions. Because the nitrogen is introduced progressively along the length of the reactor, the ammonia partial pressure in the first bed of the reactor is relatively lower and the potential for catalyst deactivation by sorption of ammonia is reduced, especially at the lower temperatures prevailing at the reactor inlet before the hydrogenation exotherm sets in to raise the temperature of the bed. The progressive introduction of the nitrogen as well as of the sulfur also leaves the hydrogen more available to deal with the thiphenes and other heterocyclics which predominate in the heavier fractions of the cracked feed. If introduced into the reactor at a lower temperature than the bed temperature, the feed will also provide quench for the hydrotreating reactions, compensating for the reaction exotherm. The introduction of the olefin-poor fraction(s) at the beginning of the reactor will also tend to limit the exotherm by reducing the exothermic olefin hydrogenation reactions in the upper part of the reactor; in the lower part of the reactor where most of the olefins enter, the space velocity is higher and the heat of reaction will be carried away by the greater volume of material passing through this portion of the reactor.

The spaced introduction of the cracked feed therefore represents a favorable configuration for the gasoline upgrading process, permitting the feed to be segregated according to olefin and sulfur contents and treated in a manner which benefits both the low sulfur olefin-rich front end as well as the low-olefin sulfur-rich back end, besides conferring processing improvements such as a potential for reducing hydrogen consumption.

The cracked feed may be fractionated into whatever number of fractions may be convenient for the equipment or according to the olefin and sulfur distributions in the cracked feed. At least two fractions are of course required and three, as described above, will result in the advantages described. More than three will not normally result in any further improvement and therfore wil not normally be preferred. Cut points between the fractions will depend on the boiling range of the original cracked feed as well as the sulfur distribution in the feed. In the case of the light naphtha mentioned above, extending from about $C_6$ to 330° F. ($C_6$ to 165° C.), a cut point of about 250° F. (about 120° C.) for a two way split or at about 200° and 260° F. (about 93° and 127° C.) for a three way split will normally be satisfactory. For a full range naphtha typically having a boiling range of about $C_5$ to 420° F. ($C_5$ to 215° C.), a cut at 300° F. (about 150° C.) for a two way split or at 250° and 350° F. (about 120° and 177° C.) for a three way split will be typical. With feeds which have extended 95 percent points above about 380° F., it will normally suffice if the highest boiling fraction has an initial point of about 290° F., as described above since the olefin content above this point is relatively low while the sulfur content is quite high. Further fractionation at higher temperatures will therefore yield no further advantage.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. These temperatures are average bed temperatures and will, of course, vary according to the feed and other reaction paramenters including, for example, hydrogen pressure and catalyst activity. The spaced introduction of the feed will also affect the temperature profile of the bed and again, this effect will vary according to the temperature of the feed fractions entering the reactor at any given point.

The conditions in the hydrotreating reactor should be adjusted not only to obtain the desired degree of desulfurization. When operating in cascade mode (no interstage separation or heating) they may also be selected to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity for the hydrodesulfurization step overall is typically about 0.5 to 10 LHSV ($hr^{-1}$), preferably about 1 to 6 LHSV ($hr^{-1}$), based on the toal feed and the total catalyst volume although the space velocity will vary along the length of the reactor as a result of the stepwise introduction of the feed. The hydrogen to hydrocarbon ratio in the feed is typically about 500 to 5000 SCF/Bbl (about 90 to 900 $n.1.1^{-1}$), usually about 1000 to 2500 SCF/B (about 180 to 445 $n.1.1^{-1}$.), again based on the total feed to hydrogen volumes. The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

A change in the volume of gasoline boiling range material typically takes place in the first step. Although some decrease in volume occurs as the result of the conversion to lower boiling products ($C_5$-), the conversion to $C_5$- products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5$+) materials may occur. The process should normally be operated under a combination of conditions such that the desulfurization should be at least about 50%, preferably at least about 75%, as compared to the sulfur content of the feed.

Octane Restoration—Second Step Processing

After the hydrotreating step, the hydrotreated intermediate product is passed to the second step of the process in which cracking takes place in the presence of the acidic functioning catalyst. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

The separation of the light ends at this point may be desirable if the added complication is acceptable since the saturated $C_4$–$C_6$ fraction from the hydrotreater is a highly suitable feed to be sent to the isomerizer for conversion to iso-paraffinic materials of high octane rating; this will avoid the conversion of this fraction to non-gasoline ($C_5$-) products in the second stage of the process. Another process configuration with potential advantages is to take a heart cut, for example, a 195°-302° F. (90°-150° C.) fraction, from the first stage product and send it to the reformer where the low octane naphthenes which make up a significant portion of this fraction are converted to high octane aromatics. The heavy portion of the first stage effluent is, however, sent to the second step for restoration of lost octane by treatment with the acid catalyst. The hydrotreatment in the first stage is effective to desulfurize and denitrogenate the catalytically cracked naphtha which permits the heart cut to be processed in the reformer. Thus, the preferred configuration in this alternative is for the second stage to process the $C_8+$ portion of the first stage effluent and with feeds which contain significant amounts of heavy components up to about $C_{13}$ e.g. with $C_9$-$C_{13}$ fractions going to the second stage, improvements in both octane and yield can be expected.

The conditions used in the second step of the process are those which result in a controlled degree of shape-selective cracking of the desulfurized, hydrotreated effluent from the first step produces olefins which restore the octane rating of the original, cracked feed at least to a partial degree. The reactions which take place during the second step are mainly the shape-selective cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating-×volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$-) during the second stage is held to a minimum. However, because the cracking of the heavier portions of the feed may lead to the production of products still within the gasoline range, no not conversion to $C_5-$ products may take place and, in fact, a net increase in $C_5+$ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials are exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. Nos. 4,962,256 and 4,954,325 to which reference is made for a description of this zeolite and its preparation and properties. Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The catalyst should have sufficient acid activity to have cracking activity with respect to the second stage feed (the intermediate fraction), that is sufficient to convert the appropriate portion of this material as feed. One measure of the acid activity of a catalyst is its alpha number, as discussed in application Ser. Nos. 07/745,311 and 07/850,106, to which reference is made for a description of the alpha characterization. The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material . Examples of these materials are well known and typically include silica, silica-alumina, silica-zirconia, silica-titania, alumina.

The catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions as well as possibly bringing about recombination of inorganic sulfur. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the second conversion catalyst will usually be determined by the type of conversion process which is being carried out and will normally be operated as a a down-flow, liquid or mixed phase, fixed bed process or as an an up-flow, fixed bed, liquid or mixed phase process.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step in cascade operation. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

Further increases in the volumetric yield of the gasoline boiling range fraction of the product, and possibly also of the octane number (particularly the motor octane number), may be obtained by using the $C_{3}$-$C_{4}$ portion of the product as feed for an alkylation process to produce alkylate of high octane number. The light ends from the second step of the process are particularly suitable for this purpose since they are more olefinic than the comparable but saturated fraction from the hydrotreating step. Alternativley, the olefinic light ends from the second step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In one example of the operation of this process, it is reasonable to expect that, with a heavy cracked naphtha feed, the first stage hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5% and, if the sulfur content is high in the feed, that this octane reduction could go as high as about 15%.

The second stage of the process should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

EXAMPLES

The following examples illustrate the operation of the present process. In these examples, parts and percentages are by weight unless they are expressly stated to be on some other basis. Temperatures are in °F. and pressures in psig, unless expressly stated to be on some other basis.

In the following examples, unless it is indicated that there was some other feed, the same heavy cracked naphtha, containing 2% sulfur, was subjected to processing as set forth below under conditions required to allow a maximum of only 300 ppmw sulfur in the final gasoline boiling range product. The properties of this naphtha feed are set out in Table 4 below.

TABLE 4

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, ASTM D-2887, | °F./°C. |
| 5% | 289/143 |
| 10% | 355/207 |
| 30% | 405/224 |
| 50% | 435/234 |
| 70% | 455/253 |
| 90% | 482 |
| 95% | 488 |

Table 5 below sets out the properties of the catalysts used in the two operating conversion stages:

TABLE 5

| | Catalyst Properties | |
|---|---|---|
| | Hydrodesulfurization 1st stage Catalyst | ZSM-5[1] 2nd stage Catalyst |
| Composition, wt % | | |
| Nickel | — | 1.0 |
| Cobalt | 3.4 | — |
| $MoO_3$ | 15.3 | — |
| Physical Properties | | |
| Particle Density, g/cc | — | 0.98 |
| Surface Area, $m^2/g$ | 260 | 336 |
| Pore Volume, cc/g | 0.55 | 0.65 |
| Pore Diameter, A | 85 | 77 |

[1]65 wt % ZSM-5 and 35 wt % alumina

Both stages of the process were carried out in an isothermal pilot plant at the same conditions in the following examples: pressure of 600 psig, space velocity of 1 LHSV, a hydrogen circulation rate of 3200 SCF/Bbl (4240 kPa abs, 1 hr.$^{-1}$ LHSV, 570 n.l.l$^{-1}$.). experiments were run at reactor temperatures from 500° to 775° F. (about 260° to 415° C.).

In all the examples, the process according to the invention was operated in a cascade mode with both catalyst bed/reaction zones operated at the same pressure and space velocity and with no intermediate separation of the intermediate product of the hydrodesulfurization.

COMPARISON EXAMPLES (HDS ONLY)

Figure 2:
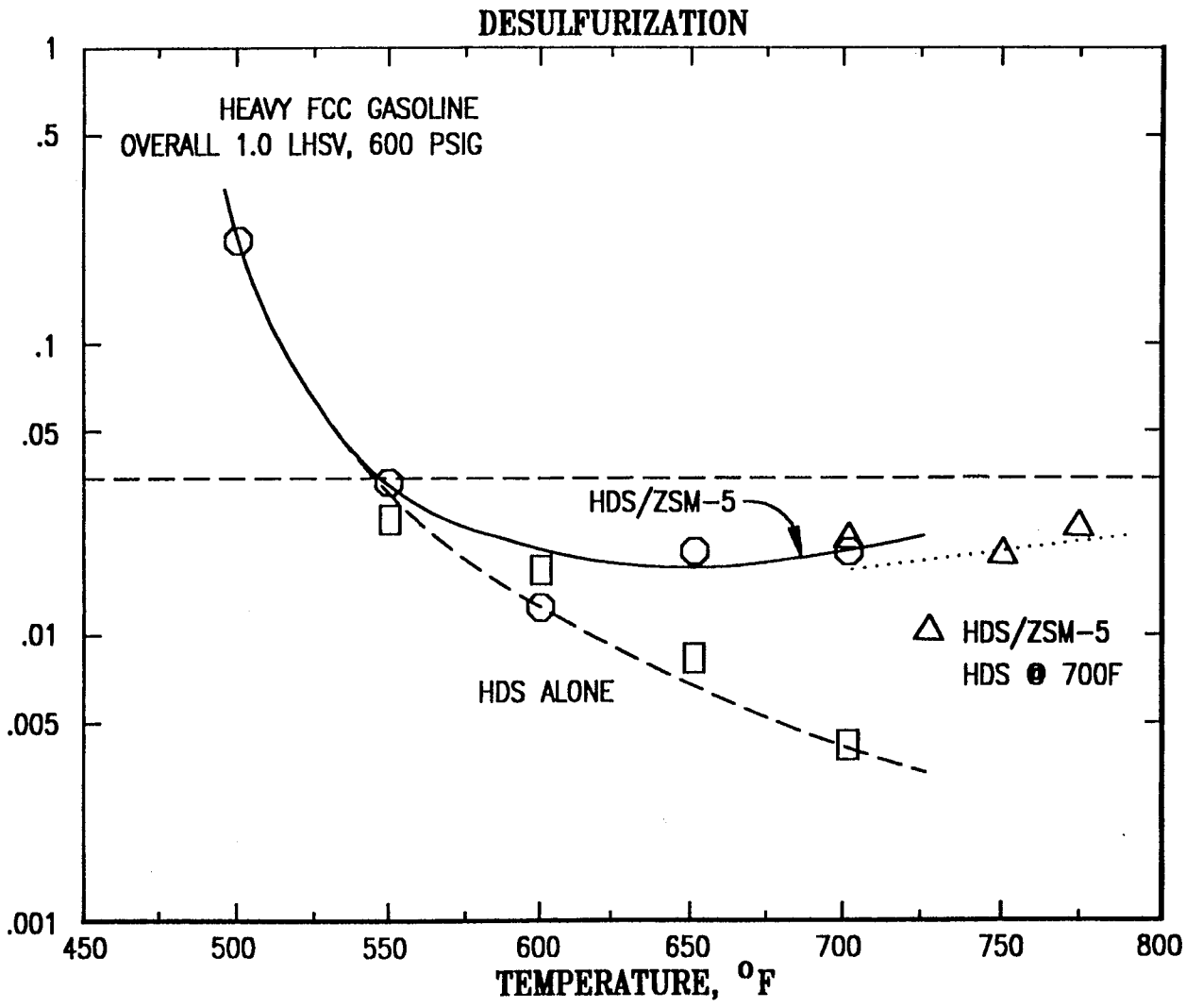
FIGS. 2 and 3 are graphs illustrating the performance of the catalysts in the two-step process.
Figure 3:
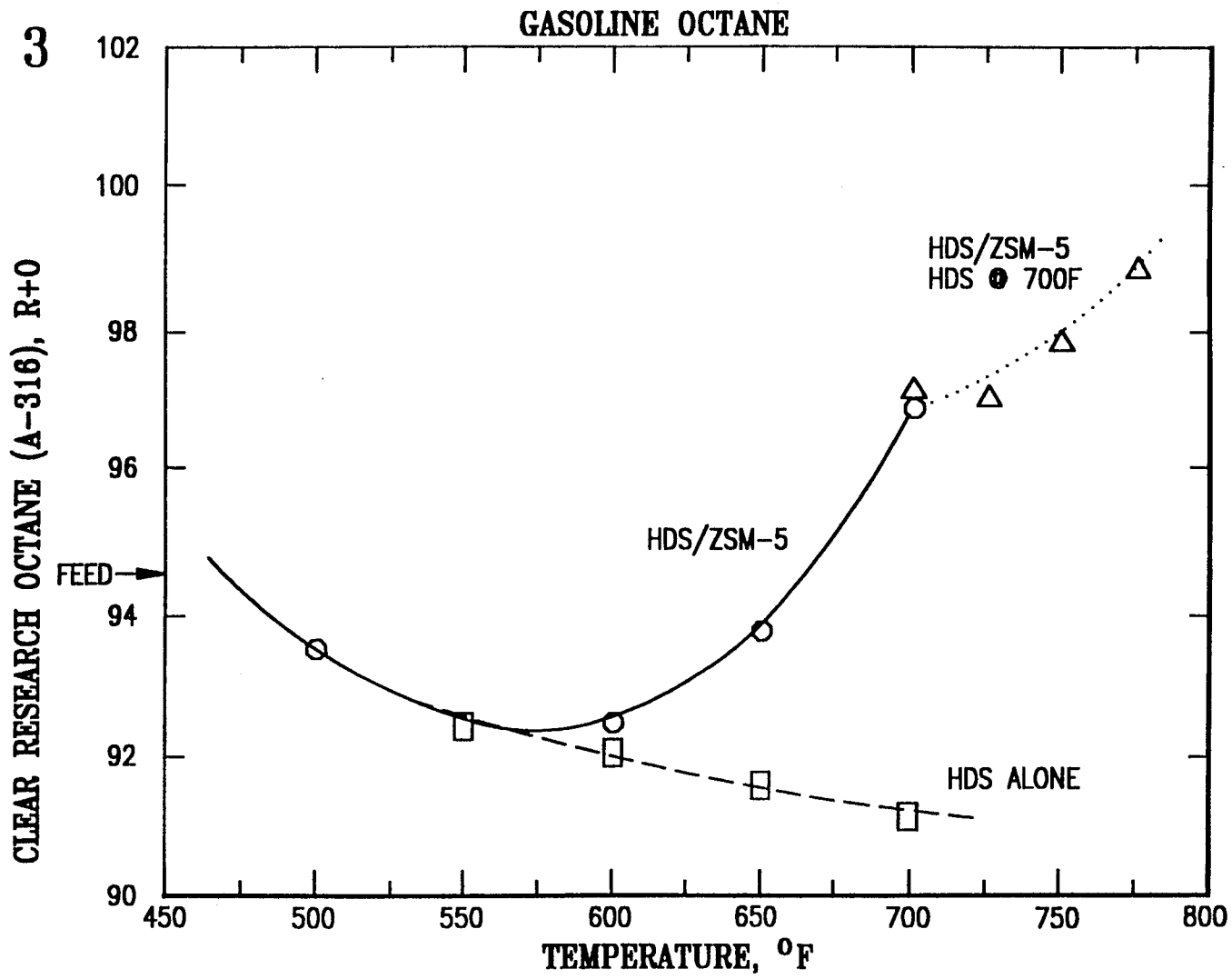

The process was operated with only a hydrodesulfurization reaction zone. At a reaction temperature of 550° F. (288° C.), the product had a sulfur content of about 300 ppmw, and a clear research octane of about 92.5. As the temperature of the desulfurization was increased, the sulfur content and the octane number continued to decline, as shown in FIGS. 2 and 3 (curves HDS Alone).

EXAMPLES OF HDS FOLLOWED BY ZSM-5 UPGRADING WITH BOTH BEDS AT THE SAME TEMPERATURE

The hydrodesulfurization was run in cascade with ZSM-5 upgrading without intermediate hydrogen sulfide separation, with both beds under isothermal conditions. The results are again shown in FIGS. 2 and 3 (curves HDS/ZSM-5).

At a reaction temperature of 550° F. (288° C.), the product had slightly higher or about the same sulfur content as the hydrodesulfurization alone, that is a sulfur content of about 300 ppmw, and about the same clear research octane of about 92.5. As the temperature was increased to 600° F. (315° C.), the sulfur content of the product declined to about 200 ppmw, below that of the hydrodesulfurization alone; the octane number started to increase for the cascade operation as compared to the hydrodesulfurization alone.

When the operation was carried out at an operating temperature of 685° F. (363° C.), the octane number of the finished product was substantially the same as that of the feed naphtha, at 95.6 (clear-research), which is 4.6 octane units higher than the octane number for the same operation using only hydrodesulfurization without second step upgrading, while meeting the desired sulfur content specifications.

EXAMPLES OF HDS FOLLOWED BY ZSM-5 UPGRADING WITH HDS AT 700° C. (370° C.)

The HDS bed was operated at 700° F. (370° C.) and the ZSM-5 bed at a higher temperature (up to 775° F., 413° C.) to simulate a temperature increase across the HDS bed. The octane of the product gasoline was increased to 99 (clear research). The desulfurization achieved was sufficient to meet the 300 ppmw specification, as shown in FIGS. 2 and 3.

When operating with the second stage of the process there is a substantial production of propylene, butenes and isobutane, as shown in FIG. 3 which reports the yields of these materials as a function of the operating temperatures. Using hydrodesulfurization alone, it will be apparent that substantially no $C_3$ and $C_4$ compounds are produced. By contrast, with the combination process, whether operated at constant temperature or with the ZSM-5 bed at higher temperature, there is a substantial quantity of these light materials formed, and the proportion formed increases with temperature.

Therefore, operating the process at progressively higher temperatures increases the production of desirable light fractions, increases the octane number of the gasoline boiling range product fractions, and effectively desulfurizes the gasoline boiling range product to a sufficient extent.

EXAMPLES OF COMBINED HDS/ZSM-5 UPGRADING WITH FEEDS OF DIFFERING BOILING RANGE

The feed was cascaded from the first stage hydrodesulfurization to the second stage (ZSM-5) upgrading without intermediate separation between to two stages. The intermediate product resulting from the hydrodesulfurization stage conversion had properties, including sulfur content and octane number, which were consistent with the properties of the same type of feed converted in a conventional commercially operating hydrotreater. The product resulting from the second stage upgrading has physical properties, including sulfur content and octane number, which demonstrate the improvement obtained by the two-stage operation. The operating conditions were 0.84 LHSV (hr.$^{-1}$),3200 SCF/Bbl (570 n.l.l$^{-1}$.) hydrogen:oil and 600 psig (4240 kPa abs) pressure with the temperature varied as described below. The results are set out in Table 6 below.

A full range FCC naphtha was hydrodesulfurized in Cases 1 and 2 in a first (HDS) reaction zone at 700° F. (370° C.). There was substantially complete sulfur removal from the feed at a substantial loss in octane number. In Case 1, the second stage zeolitic upgrading was carried out under relatively mild conditions and served to minimize the loss of octane. In Case 2, operating the second stage conversion at higher severity caused the octane number of the final product to more closely approach that of the feed. Cases 3 and 4 show the same results achieved with a feed of somewhat heavier FCC naphtha.

TABLE 6

HDS/ZSM-5 Upgrading of FCC Naphtha Cuts

| | Cases | | | |
|---|---|---|---|---|
| | 1 | 2 | 3 | 4 |
| Reactor 1 Temp., °F. | 700 | 700 | 700 | 700 |
| Reactor 2 Temp., °F. | 700 | 750 | 700 | 750 |
| Feed | | | | |
| Boiling Range, °F. | 95-500 | 95-500 | 230-500 | 230-500 |
| API Gravity | 54.3 | 54.3 | 34.2 | 34.2 |
| Sulfur, ppmw | 3800 | 3800 | 5200 | 5200 |
| Nitrogen, ppmw | 44 | 44 | 85 | 85 |
| Bromine No. | 45.81 | 45.81 | 13.86 | 13.86 |
| Research Octane | 93.5 | 93.5 | 95.8 | 95.8 |
| Motor Octane | 81.6 | 81.6 | 83.5 | 83.5 |
| Wt % $C_{5++}$ | 99.8 | 99.8 | 100.0 | 100.0 |
| Vol % $C_5$ | 99.8 | 99.8 | 100.0 | 100.0 |
| Reactor 1 Product | | | | |
| Sulfur, ppmw | <20 | <20 | <20 | <20 |
| Nitrogen, ppmw | 2 | 2 | <1 | <1 |
| Bromine No. | 0.11 | 0.11 | 0.03 | 0.03 |
| Research Octane | 80.8 | 80.8 | 89.3 | 89.3 |
| Motor Octane | 75.3 | 75.3 | 78.4 | 78.4 |
| Wt % $C_5$ | 99.2 | 99.2 | 100.2 | 100.2 |
| Vol % $C_{5+}$ | 97.6 | 97.6 | 102.2 | 102.2 |
| Vol % $C_3$ Olefins | 0.0 | 0.0 | 0.0 | 0.0 |
| Vol % $C_4$ Olefins | 0.0 | 0.0 | 0.0 | 0.0 |
| Vol % Isobutane | 0.0 | 0.0 | 0.0 | 0.0 |
| Potential Alkylate, vol %(1) | 0.0 | 0.0 | 0.0 | 0.0 |
| Reactor 2 Product | | | | |
| Sulfur, ppmw | <20 | <20 | <20 | <20 |
| Nitrogen, ppmw | <1 | <1 | <1 | <1 |
| Bromine No. | 1.63 | 1.49 | 1.51 | 0.91 |
| Research Octane | 87.4 | 92.9 | 93.2 | 97.3 |
| Motor Octane | 80.2 | 84.5 | 82.0 | 86.2 |
| Wt % $C_5$ | 94.9 | 82.7 | 97.3 | 91.0 |
| Vol % $C_{5+}$ | 92.5 | 80.4 | 98.7 | 91.7 |
| Vol % $C_3$ Olefins | 0.2 | 0.3 | 0.2 | 0.3 |
| Vol % $C_4$ Olefins | 0.4 | 0.4 | 0.5 | 0.4 |
| Vol % Isobutane | 1.6 | 5.8 | 1.0 | 3.7 |
| Potential Alkylate, Vol % | 1.0 | 1.2 | 1.2 | 1.2 |

(1)Potential alkylate defined as 1.7 × ($C_4^=$ + $C_3^=$, % vol).

EXAMPLES OF THE EFFECT OF HDS SEVERITY ON ZSM-5 UPGRADING

In the two cases illustrated here, the second (ZSM-5) stage, the temperature was held constant at 700° F. (370° C.) while the HDS temperature was varied to either 350° F. (177° C.) or 550° F. (288° C.) at 0.84 LHSV (hr.$^{-1}$, 3200 SCF/Bbl (570 n.l.l$^{-1}$.) hydrogen-:oil, 600 psig (4240 kPa abs) pressure. The results are shown in Table 7 below.

Case 1 demonstrates the results of upgrading cracked naphtha with ZSM-5 without prior hydrotreatment. During the experiment, the temperature of the first reactor was 350° F., which is sufficiently low to make this stage hydrotreating ineffective and made this first stage merely a pre-heater. The second stage alone did not remove the required amount of sulfur.

In Case 2, mild hydrotreatment prior in the first stage did achieve the required desulfurization. However, the first stage of hydrotreatment completely saturated the olefins in the feed, as indicated by the bromine number reduction, and this resulted in a 9 number loss of research octane. The second stage processing over the ZSM-5 catalyst restored the lost octane.

TABLE 7

Effect of Hydrotreating Severity on ZSM-5 Upgrading of FCC Naphtha

| | Case | |
|---|---|---|
| | 1 | 2 |
| Reactor 1 Temp., °F. | 350 | 550 |
| Reactor 2 Temp., °F. | 700 | 700 |
| Feed | | |
| Boiling Range, °F. | 95-500 | 95-500 |
| API Gravity | 54.3 | 54.3 |
| Sulfur, ppmw | 3800 | 3800 |
| Nitrogen, ppmw | 44 | 44 |
| Bromine No. | 45.81 | 45.81 |
| Research Octane | 93.5 | 93.5 |
| Motor Octane | 81.6 | 81.6 |
| Wt % $C_{5+}$ | 99.8 | 99.8 |
| Vol % $C_{5+}$ | 99.8 | 99.8 |
| Reactor 1 Product | | |
| Sulfur, ppmw | — | <20 |
| Nitrogen, ppmw | — | 3 |
| Bromine No. | — | 0.08 |
| Research Octane | — | 84.5 |
| Motor Octane | — | 76.8 |
| Wt % $C_{5+}$ | — | 99.3 |
| Vol % $C_{5+}$ | — | 96.2 |
| Vol % $C_3$ Olefins | — | 0.0 |
| Vol % $C_4$ Olefins | — | 0.0 |
| Vol % Isobutane | — | 0.0 |
| Potential Alkylate Vol % | — | 0.0 |
| Reactor 2 Product | | |
| Sulfur, ppmw | 1700 | 30 |
| Nitrogen, ppmw | 25 | <1 |
| Bromine No. | 12.70 | 1.40 |
| Research Octane | 94.0 | 90.0 |
| Motor Octane | 83.7 | 82.0 |
| Wt % $C_{5+}$ | 94.3 | 94.7 |
| Vol % $C_{5+}$ | 88.8 | 92.0 |
| Vol % $C_3$ Olefins | 0.5 | 0.2 |
| Vol % $C_4$ Olefins | 1.1 | 0.4 |
| Vol % Isobutane | 1.9 | 1.6 |
| Potential Alkylate vol % | 2.7 | 1.0 |

EXAMPLES WITH ZEOLITES OTHER THAN ZSM-5 (SECOND STEP)

These evaluations were conducted in a similar manner to those described above for the HDS/ZSM-5 studies using an isothermal pilot plant with both reaction zones at the same temperature (700° F., 370° C.) and $H_2$ pressure (600 psig, 4240 kPa). The same Co-Mo/$Al_2O_3$ hydrotreating catalyst was used but the second stage catalyst were MCM-22 and zeolite beta. The zeolite beta catalyst was prepared from a steamed H-beta zeolite and the MCM-22 catalyst from unsteamed H-MCM-22 with alumina binder in each case. The feed was a heavy catalytically cracked gasoline similar to that used in the ZSM-5 studies; its properties are shown in Table 8 together with those for the feed used in the ZSM-5 studies.

The results are given below in Table 9 together the results obtained with the ZSM-5 catalyst at 700° F. (370° C.) for comparison.

TABLE 8

Feed Properties - Heavy Gasoline

| | Catalyst | |
|---|---|---|
| | MCM-22/Beta | ZSM-5 |
| H, wt % | 10.64 | 10.23 |
| S, wt % | 1.45 | 2.0 |
| N, wt % | 170 | 190 |
| Bromine No. | 11.7 | 14.2 |

TABLE 8-continued

| Feed Properties - Heavy Gasoline | Catalyst | |
|---|---|---|
| | MCM-22/Beta | ZSM-5 |
| Paraffins, vol % | 24.3 | 26.5 |
| Research Octane | 94.3 | 95.6 |
| Motor Octane | 82.8 | 81.2 |
| Distillation, D 2887 (F.°/C.°) | | |
| 5% | 284/140 | 289/143 |
| 30% | 396/202 | 405/207 |
| 50% | 427/219 | 435/224 |
| 70% | 451/233 | 453/234 |
| 95% | 492/256 | 488/253 |

TABLE 9

| Catalyst Evaluations | Ni ZSM-5 | MCM-22 | Beta |
|---|---|---|---|
| 420°+ F. Conv., % | 15.6 | 27.4 | 31.4 |
| $C_3$=, wt % | 0.22 | 0.14 | 0.08 |
| $C_4$=, wt % | 0.51 | 1.10 | 0.35 |
| $C_5$=, wt, % | 0.47 | 1.90 | 0.49 |
| Paraffins | | | |
| Branched $C_4$, wt % | 1.00 | 1.21 | 1.47 |
| Branched $C_5$, wt % | 0.86 | 0.72 | 1.60 |

These results show that both zeolite beta and MCM-22 are more active for 420° F.+ (215° C.+) conversion than the ZSM-5 but both are slightly less effective for octane enhancement than ZSM-5. The MCM-22 catalyst, however, produces more $C_4/C_5$ olefins than either ZSM-5 or zeolite beta (Table 6). The zeolite beta catalyst has a very high yield of isobutanes and isopentanes (Table 6). The H-form beta and the MCM-22 both achieved desulfurization to less than 25 ppmw as compared to 180 ppmw for the NiZSM-5.

We claim:

1. A process of upgrading a sulfur-containing feed fraction boiling in the gasoline boiling range which comprises:

fractionating the feed into a plurality of fractions of differring boiling range, hydrodesulfurizing the fractions by introducing them into a fixed bed hydrodesulfurization reactor at spaced locations along the length of the hydrodesulfurization reactor in which the introduced fractions are contacted with a hydrodesulfurization catalyst under conditions of elevated temperature, elevated pressure and in an atmosphere comprising hydrogen, to produce an intermediate product comprising a normally liquid fraction which has a reduced sulfur content number as compared to the feed;

contacting at least the gasoline boiling range portion of the intermediate product in a second reaction zone with a catalyst of acidic functionality to convert it to a product comprising a fraction boiling in the gasoline boiling range having a higher octane number than the gasoline boiling range fraction of the intermediate product.

2. The process as claimed in claim 1 in which said feed fraction comprises a light naphtha fraction having a boiling range within the range of $C_6$ to 330° F.

3. The process as claimed in claim 1 in which said feed fraction comprises a full range naphtha fraction having a boiling range within the range of $C_5$ to 420° F.

4. The process as claimed in claim 1 in which said feed fraction comprises a heavy naphtha fraction having a boiling range within the range of 330° to 500° F.

5. The process as claimed in claim 1 in which said feed fraction comprises a heavy naphtha fraction having a boiling range within the range of 330° to 412° F.

6. The process as claimed in claim 1 in which said feed is a cracked naphtha fraction comprising olefins.

7. The process as claimed in claim 1 in which said feed fraction comprises a naphtha fraction having a 95 percent point of at least about 350° F.

8. The process as claimed in claim 7 in which said feed fraction comprises a naphtha fraction having a 95 percent point of at least about 380° F.

9. The process as claimed in claim 8 in which said feed fraction comprises a naphtha fraction having a 95 percent point of at least about 400° F.

10. The process of claim 1 in which the feed is fractionated into at least two fractions of differing boiling range and the lower boiling fraction is introduced into the hydrodesulfurization reactor at its inlet and the higher boiling fraction is introduced into the hydrodesulfurization reactor at a location along the length of the reactor between the inlet of the reactor and its outlet.

11. The process of claim 1 in which the feed is fractionated into at least three fractions of differing boiling range and the lowest boiling fraction is introduced into the hydrodesulfurization reactor at its inlet and the higher boiling fractions are introduced into the hydrodesulfurization reactor at spaced locations along the length of the reactor between the inlet of the reactor and its outlet, in order of decreasing boiling range of the fractions.

12. The process of claim 1 in which the feed is fractionated into a fraction having a 290° F.+ boiling range and at least one lower boiling fraction.

13. The process of claim 12 in which the lower boiling fractions include a 200° to 290° F. fraction.

14. The process of claim 13 in which the lower boiling fractions include a $C_5$-150° F. fraction.

15. The process as claimed in claim 1 in which the acidic catalyst comprises an intermediate pore size zeolite in the aluminosilicate form.

16. The process as claimed in claim 15 in which the intermediate pore size zeolite has the topology of ZSM-5.

17. The process as claimed in claim 1 in which the hydrodesulfurization is carried out at a temperature of about 400° to 800° F., a pressure of about 50 to 1500 psig, a space velocity of about 0.5 to 10 LHSV (based on total hydrocarbon feed), and a hydrogen to hydrocarbon ratio of about 500 to 5000 standard cubic feet of hydrogen per barrel of total feed.

18. The process as claimed in claim 17 in which the hydrodesulfurization is carried out at a temperature of about 500° to 750° F., a pressure of about 300 to 1000 psig, a space velocity of about 1 to 6 LHSV based on the total hydrocarbon feed, and a hydrogen to hydrocarbon ratio of about 1000 to 2500 standard cubic feet of hydrogen per barrel of total feed.

19. The process as claimed in claim 1 in which the second stage upgrading is carried out at a temperature of about 300° to 900° F., a pressure of about 50 to 1500 psig, a space velocity of about 0.5 to 10 LHSV, and a hydrogen to hydrocarbon ratio of about 0 to 5000 standard cubic feet of hydrogen per barrel of feed.

20. The process as claimed in claim 19 in which the second stage upgrading is carried out at a temperature of about 350° to 800° F., a pressure of about 300 to 1000 psig, a space velocity of about 1 to 6 LHSV, and a hydrogen to hydrocarbon ratio of about 100 to 2500 standard cubic feet of hydrogen per barrel of feed.

21. A process of upgrading a catalytically cracked, olefinic, sulfur-containing gasoline feed having a sulfur content of at least 50 ppmw, an olefin content of at least 5 percent and a 95 percent point of at least 325° F., which process comprises:

separating the sulfur-containing feed into a plurality of fractions of differing boiling range, hydrodesulfurizing the feed fractions with a hydrodesulfurization catalyst by introducing the feed fractions into a fixed-bed hydrodesulfurization reactor at spaced locations along the length of the reactor in order of descending boiling range of the fractions and carrying out the hydrodesulfurization under conditions of elevated temperature, elevated pressure and in an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with an acidic zeolite catalyst to convert it to a product comprising a fraction boiling in the gasoline boiling range having a higher octane number than the gasoline boiling range fraction of the intermediate product.

22. The process as claimed in claim 21 in which the feed fraction has a 95 percent point of at least 350° F., an olefin content of 10 to 20 weight percent, a sulfur content from 100 to 5,000 ppmw and a nitrogen content of 5 to 250 ppmw.

23. The process as claimed in claim 22 in which said feed fraction comprises a naphtha fraction having a 95 percent point of at least about 380° F.

24. The process of claim 21 in which the feed is fractionated into at least two fractions of differing boiling range and the higher boiling fraction is introduced into the hydrodesulfurization reactor at its inlet and the lower boiling fraction is introduced into the hydrodesulfurization reactor at a location along the length of the reactor between the inlet of the reactor and its outlet.

25. The process of claim 21 in which the feed is fractionated into at least three fractions of differing boiling range and the highest boiling fraction is introduced into the hydrodesulfurization reactor at its inlet and the lower boiling fractions are introduced into the hydrodesulfurization reactor at spaced locations along the length of the reactor between the inlet of the reactor and its outlet, in order of decreasing boiling range of the fractions.

26. The process of claim 24 in which the feed is fractionated into a fraction having a 290° F.+ boiling range and at least one lower boiling fraction.

27. The process of claim 24 in which the lower boiling fractions include a 200° to 290° F. fraction.

28. The process of claim 24 in which the lower boiling fractions include a $C_5$-150° F. fraction.

29. The process as claimed in claim 21 in which the acidic catalyst comprises an intermediate pore size zeolite in the aluminosilicate form.

30. The process as claimed in claim 29 in which the intermediate pore size zeolite has the topology of ZSM-5.

* * * * *